US011454013B2

(12) United States Patent
Mielke et al.

(10) Patent No.: US 11,454,013 B2
(45) Date of Patent: Sep. 27, 2022

(54) AUTOMATIC DISINFECTION OF THE SPRAY NOZZLE OF A BIDET/TOILET COMBINATION

(71) Applicant: GROHE AG, Hemer (DE)

(72) Inventors: Achim Mielke, Porta Westfalica (DE); Olaf Schneider, Hagen (DE)

(73) Assignee: GROHE AG, Hemer (DE)

( * ) Notice: Subject to any disclaimer, the term of this patent is extended or adjusted under 35 U.S.C. 154(b) by 0 days.

(21) Appl. No.: 17/295,989

(22) PCT Filed: Nov. 11, 2019

(86) PCT No.: PCT/EP2019/080831

§ 371 (c)(1),
(2) Date: May 21, 2021

(87) PCT Pub. No.: WO2020/104229

PCT Pub. Date: May 28, 2020

(65) Prior Publication Data

US 2022/0018105 A1 Jan. 20, 2022

(30) Foreign Application Priority Data

Nov. 23, 2018 (DE) ..... 102018129626.6

(51) Int. Cl.
*E03D 9/00* (2006.01)
*E03D 9/08* (2006.01)

(52) U.S. Cl.
CPC ..... *E03D 9/002* (2013.01); *E03D 9/08* (2013.01)

(58) Field of Classification Search
CPC ..... E03D 9/002
USPC ..... 4/420.5, 420.4, 420, 421
See application file for complete search history.

(56) References Cited

U.S. PATENT DOCUMENTS

| | | | | |
|---|---|---|---|---|
| 2004/0103471 | A1 | 6/2004 | Haberkorn | |
| 2010/0294850 | A1* | 11/2010 | Bowen | B05B 1/185 239/398 |
| 2014/0101838 | A1* | 4/2014 | Gupta | B05B 15/16 4/448 |
| 2019/0161952 | A1* | 5/2019 | Muhi Deen | E03D 9/085 |

FOREIGN PATENT DOCUMENTS

| | | |
|---|---|---|
| CH | 698 388 | 7/2009 |
| CH | 705 351 | 2/2013 |
| DE | 20 2012 001 170 | 5/2013 |
| WO | 2006/079232 | 8/2006 |
| WO | 2013/020240 | 2/2013 |

OTHER PUBLICATIONS

International Search Report dated Feb. 17, 2020, in International (PCT) Application No. PCT/EP2019/080831.

* cited by examiner

*Primary Examiner* — Lori L Baker
(74) *Attorney, Agent, or Firm* — Wenderoth, Lind & Ponack, L.L.P.

(57) ABSTRACT

The invention relates to a bidet/toilet combination (1) comprising: —a toilet bowl (2) surrounding a bowl space (3); —a spray device (4) comprising a spray nozzle (5) located in the bowl space (3); wherein the spray nozzle (5) is arranged and designed to adopt a rest position (6) and a use position (7). The invention also relates to a method for operating said toilet and to the use of said bidet/toilet combination.

9 Claims, 3 Drawing Sheets

AUTOMATIC DISINFECTION OF THE SPRAY NOZZLE OF A BIDET/TOILET COMBINATION

CROSS-REFERENCE TO RELATED APPLICATIONS

This application is a U.S. national stage application filed under 35 U.S.C. § 371 of international application no. PCT/EP2019/080831, filed Nov. 11, 2019, and claims priority to German application no. 102018129626.6, filed Nov. 23, 2018, which is incorporated by reference herein in its entirety.

BACKGROUND OF THE INVENTION

This invention relates to a bidet/toilet combination, to a method for operating a toilet and to the use of a bidet/toilet combination.

Toilets (WCs) with bidet function have been known and in use for a long time. Here, a toilet is additionally equipped with at least one nozzle, often simply referred to as a bidet, for cleaning the lower abdomen of a user. In response to an actuation operation, for example, a motor-driven nozzle arm of the bidet can advance into the toilet bowl, direct a bidet water jet upwards, and retract after function. In many cases, such bidet mechanisms are equipped with additional mechanisms, for example water heaters such as boilers or continuous flow heaters, warm air dryers, nozzle arm cleaning mechanisms, etc.

Standard nozzle arm cleaning mechanisms typically comprise a rinse water hose, which is used to apply rinse water tangentially to the front surface of the nozzle arm, in the retracted state thereof, in order to clean the same. An example of such a standard nozzle arm cleaning mechanism is described in DE 20 2012 001 170 U1.

In general, this invention addresses the problem of overcoming, at least partially, a disadvantage arising from the prior art. In particular, this invention addresses the problem of improving the hygiene in a bidet/toilet combination comprising a spray nozzle with cleaning function.

The independent claims contribute to the at least partial solution of at least one of these problems. The dependent claims provide preferred embodiments, which contribute to the at least the partial solution of at least one of the problems.

A contribution to the solution of at least one of the problems according to the invention is made by a bidet/toilet combination comprising, as toilet components, a. a toilet bowl surrounding a bowl space;

b. a spray device comprising a spray nozzle arranged in the bowl space;

wherein the spray nozzle is arranged and designed for traveling to a rest position and to a use position, wherein the spray nozzle preferably projects further into the bowl space in the use position in comparison to the rest position;

wherein the spray device is provided with a water supply and a disinfectant supply;

wherein a disinfectant can be fed via the disinfectant supply when the spray nozzle travels to the rest position.

The bidet/toilet combination according to the invention differs from the bidet/toilet combinations with a cleaning function of the nozzle arm known from the prior art by the nozzle arm (spray nozzle) in the rest position being not only sprayed and thus cleaned using pure rinse water, but also using a disinfectant. The spray device therefore comprises a disinfectant supply in addition to the water supply known from the prior art, wherein a disinfectant can be fed via the disinfectant supply when the spray nozzle travels to the rest position.

In principle, the water provided for cleaning the spray nozzle and the disinfectant can be applied to the end face of the spray nozzle separately via separate outlets. In this case, the spray device comprises a separate water outlet and a separate disinfectant outlet, each adjacent to the end face of the spray nozzle, via which outlets these two liquids are applied either simultaneously or successively to the spray nozzle for cleaning and disinfection. However, preferably the water provided for cleaning the spray nozzle and the disinfectant is applied to the end face of the spray nozzle after prior mixing. In that case, the spray device comprises an outlet adjacent to the end face of the spray nozzle, via which the mixture of water and disinfectant is applied for cleaning and disinfection.

According to a preferred embodiment of the bidet/toilet combination according to the invention, the disinfectant supply has a disinfectant feeder, for example, a pump. Such a pump can be used to feed the disinfectant into the spray device separately from the water supply and then, advantageously after mixing with the water applied for cleaning the spray nozzle in a separate mixing device, to apply these components in the form of a mixture to the front surface of the spray nozzle from the outside. In the context of this special embodiment of the bidet/toilet combination according to the invention, particular preference is thus given to the water supply and the disinfectant supply being connected to the spray nozzle via a mixer.

In addition to the use of a separate pump for feeding the disinfectant into the spray device, suction jet can also be used to feed the disinfectant into the spray device via the water supply, wherein in that case the line used to supply the water applied for cleaning the spray nozzle functions as a suction jet pump.

According to the invention, preference is furthermore given to the disinfectant supply being connected to a disinfectant tank.

For applying the disinfectant to the spray nozzle from the outside, the disinfectant supply leads to a disinfectant outlet, wherein the disinfectant outlet is preferably arranged adjacent to the spray nozzle. If the water provided for cleaning the spray nozzle and the disinfectant are applied beforehand to the spray nozzle as a mixture in the manner described above, then the disinfectant outlet corresponds to the outlet via which the mixture of water and disinfectant is applied to the spray nozzle from the outside.

BRIEF SUMMARY OF THE INVENTION

According to the invention, preference is furthermore given to the water supply or the disinfectant supply or both having a plastic hose.

A contribution to solving at least one of the problems addressed by the invention is also made by a method for operating a toilet, comprising the steps A. provision of a bidet/toilet combination according to the invention;

B. operation of the bidet/toilet combination in a building.

The use of a bidet/toilet combination according to the invention for improving hygiene also contributes to solving of at least one of the problems addressed by the invention.

The invention is illustrated in more detail below by examples and drawings, wherein the examples and drawings do not limit the invention in any way.

DETAILED DESCRIPTION OF THE INVENTION

Figure 1:
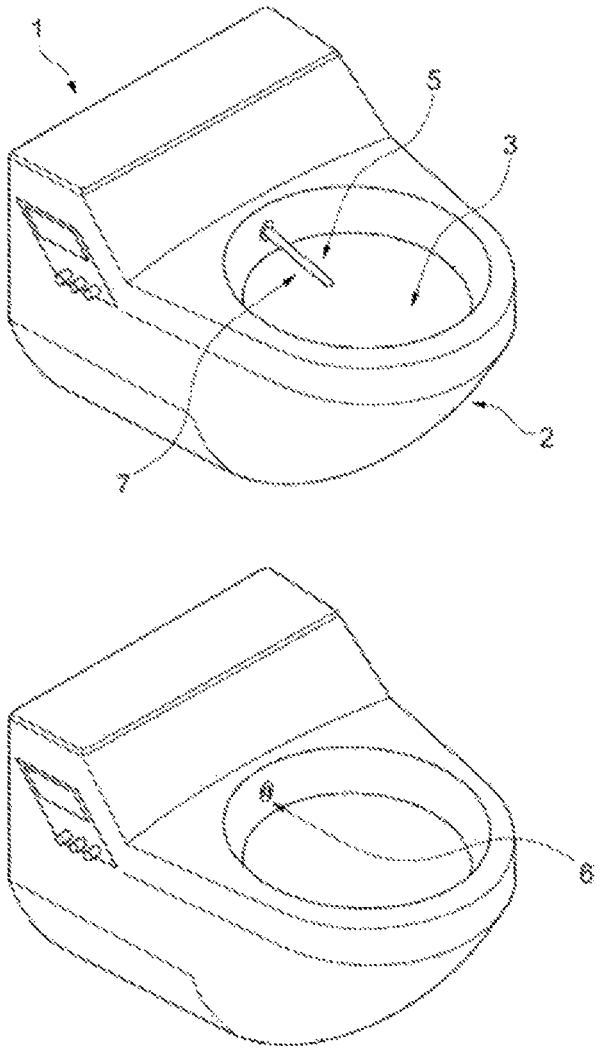
FIG. 1 shows the bidet/toilet combination 1 according to the invention, the spray nozzle 5 being in the use position 7 (upper illustration) and the spray nozzle 5 being in the rest position 6 (lower illustration)

FIG. 1 shows the bidet/toilet combination 1 according to the invention, the spray nozzle 5 being in the use position 7 (illustration above) and the spray nozzle 5 being in the rest position 6 (illustration below). The bidet/toilet combination comprises a toilet bowl 2 having a bowl space 3, into which the spray nozzle 5 projects in the use position 7 (illustration above in FIG. 1). In the rest position 6, the spray nozzle 5 is almost fully retracted into the toilet bowl 3 [sic] (illustration below in FIG. 1). In terms of its basic configuration, this bidet/toilet combination corresponds to the bidet/toilet bowl combinations with cleaning function known from the prior art.

Figure 2:
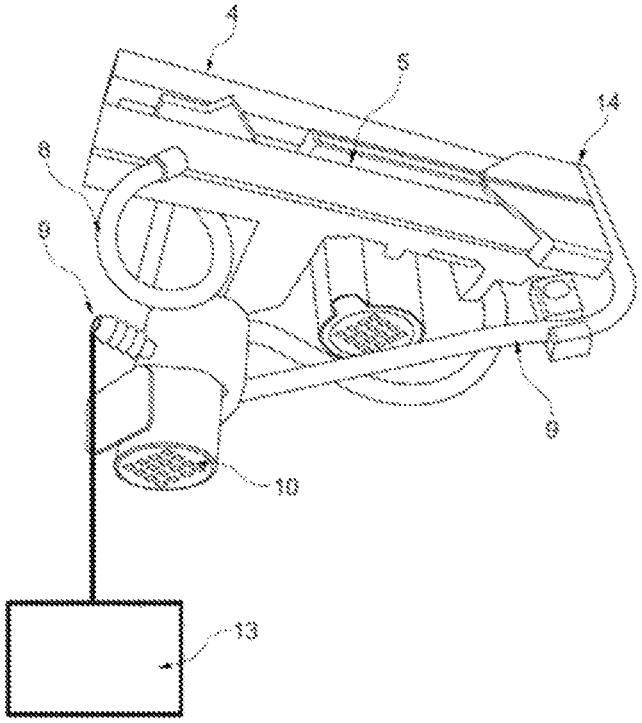
FIG. 2 shows a lateral view of the spray device 4 with cleaning function, which has been removed from the bidet/toilet combination

FIG. 2 shows a lateral view of a spray device 4 with the cleaning function, which has been removed from the bidet/toilet combination and which comprises a tubular and displaceably arranged spray nozzle 5 in the rest position 7. A water supply 8 can be discerned, via which water flows into the spray device 4 in order to clean the spray nozzle 5 therein on the end face via an outlet 12 (see FIG. 3). A disinfectant from a disinfectant tank 13 is now introduced into the spray device 4 via a disinfectant supply 9. As shown in FIG. 2, the disinfectant is introduced via the rinse water line, which functions as a suction jet pump. The mixture of water and disinfectant thus obtained is now applied, via the disinfectant outlet 12 (see FIG. 3), to the end face of the spray nozzle 5 in order to clean and in particular also to disinfect the same from the outside. It is also conceivable to use a separate pump (not shown in FIG. 2) to deliver the disinfectant and, if applicable, to apply it to the end face of the spray nozzle 5 separately from the water via another, separate outlet (also not shown in FIG. 2). Furthermore, a cover 14 can be provided on the end of the spray device 4, which faces the bowl space 3. The cover 14 is closed (i.e., it is essentially flush with the bowl space 3) when the spray nozzle 5 is in the rest position.

Figure 3:
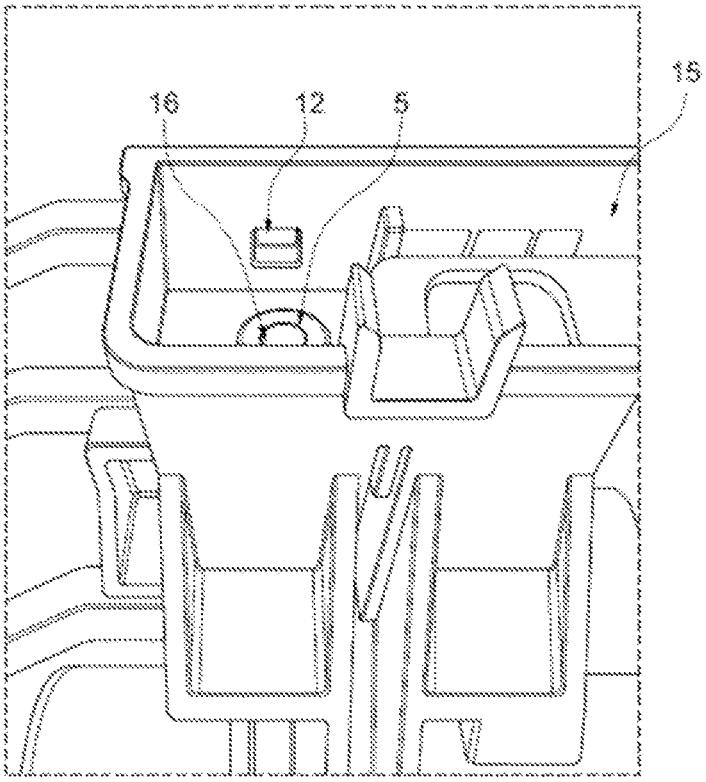
FIG. 3 shows a view from above of the spray device 4 with cleaning function illustrated in FIG. 2, viewed toward the end face of the spray nozzle 5.

FIG. 3 shows the top view of the area of the spray device 4 closed by the cover 14, indicated in FIG. 2 by a boldface arrow. When the cover 14 is closed, a rinse chamber 15 having a nozzle outlet 16 of the nozzle 5 and a disinfectant outlet 12 is formed.

LIST OF REFERENCE SYMBOLS

1 Bidet/toilet combination
2 Toilet bowl
3 Bowl space
4 Spray device
5 Spray nozzle
6 Rest position
7 Use position
8 Water supply
9 Disinfectant supply
10 Disinfectant feeder
12 Disinfectant outlet
13 Disinfectant tank
14 Cover
15 Rinse chamber
16 Nozzle outlet

The invention claimed is:

1. A bidet/toilet combination (1) comprising, as toilet components, a. a toilet bowl (2) surrounding a bowl space (3);

b. a spray device (4) comprising a spray nozzle (5) arranged in the bowl space (3);

wherein the spray nozzle (5) is arranged and designed for traveling to a rest position (6) and a use position (7);

wherein the spray device (4) comprises a water supply (8), a disinfectant supply (9), a water outlet and a disinfectant outlet (12);

wherein a disinfectant can be fed via the disinfectant supply (9) as the spray nozzle (5) travels to the rest position (6); and wherein water and the disinfectant are separately applied to an end face of the spray nozzle (5) via the water outlet and the disinfectant outlet (12).

2. The bidet/toilet combination (1) according to claim 1, wherein the disinfectant supply (9) has a disinfectant feeder (10).

3. The bidet/toilet combination (1) according to claim 2, wherein the disinfectant feeder (10) is a pump.

4. The bidet/toilet combination (1) according to claim 1, wherein the disinfectant supply (9) leads to the disinfectant outlet (12), wherein the disinfectant outlet (12) is arranged adjacent to the spray nozzle (5).

5. The bidet/toilet combination (1) according to claim 1, wherein the water supply (8) or the disinfectant supply (9) or both have a plastic hose.

6. The bidet/toilet combination (1) according to claim 1, wherein the spray nozzle (5) projects further into the bowl space (3) in the use position (7) in comparison to the rest position (6).

7. The bidet/toilet combination (1) according to claim 1, wherein the disinfectant supply (9) is connected to a disinfectant tank (13).

8. A method for operating a toilet, comprising:

a. providing the bidet/toilet combination (1) according to claim 1; and b. operating the bidet/toilet combination (1) in a building.

9. The method according to claim 8, wherein the method improves hygiene.

* * * * *